United States Patent [19]

Saito et al.

[11] Patent Number: 4,604,547

[45] Date of Patent: Aug. 5, 1986

[54] DEFLECTION SYSTEM FOR A TWO ELECTRON BEAM CATHODE RAY TUBE

[75] Inventors: Tsunenari Saito; Akio Murata; Koichi Sakai, all of Tokyo, Japan

[73] Assignee: Sony Corporation, Tokyo, Japan

[21] Appl. No.: 578,173

[22] Filed: Feb. 8, 1984

[30] Foreign Application Priority Data

Feb. 14, 1983 [JP] Japan ..... 58-22473

[51] Int. Cl.[4] ..... H01J 29/50; H01J 29/76

[52] U.S. Cl. ..... 313/413; 313/431

[58] Field of Search ..... 313/409, 410, 413, 426, 313/427, 431, 432, 433, 434, 435

[56] References Cited

U.S. PATENT DOCUMENTS 3,943,281 3/1976 Keller et al. ..... 313/409 X 4,310,776 1/1982 Duys ..... 313/412 X 4,362,964 12/1982 Sakurai et al. ..... 313/412 X

*Primary Examiner*—David K. Moore

*Assistant Examiner*—K. Wieder

*Attorney, Agent, or Firm*—Hill, Van Santen, Steadman & Simpson

[57] ABSTRACT

A cathode ray tube including first and second cathodes mounted parallel to each other in the horizontal direction, and a deflecting device disposed along the passages of the first and second electron beams which are emitted from the first and second cathodes so as to apply to the first and second electron beams a rotational force with the axis of the tube as its center, and whereby the first and second electron beams impinge on the phosphor screen at positions which are spaced apart from each other by a distance of approximately half the distance between adjacent scanning lines in the vertical direction.

8 Claims, 16 Drawing Figures

DEFLECTION SYSTEM FOR A TWO ELECTRON BEAM CATHODE RAY TUBE

BACKGROUND OF THE INVENTION

1. Field of the Invention

The present invention relates generally to cathode ray tubes and more particularly is directed to a cathode ray tube in which two electron beams simultaneously scan a phosphor screen which are spaced a distance of approximately half the spacing between adjacent scanning lines in the vertical direction.

2. Description of the Prior Art

In general, in the display on a picture screen by the interlaced system, when there are 525 scanning lines, one field is formed of 262.5 scanning lines, which then is transmitted at a frequency of 60 Hz so that field flicker is suppressed. Moreover, in order to obtain the vertical resolution, the field next to a first field is scanned with a displacement corresponding to half the distance between adjacent scanning lines.

In this case, although microscopically the number of images is 60 sheets/sec, microscopically one scanning line is scanned every 1/30 second and its display period is 1/30 second. Therefore, the scanning by one scanning line can result in flicker. In other words, line flicker exists.

In order to reduce the line flicker, it is sufficient to shorten the display period of one scanning line to less than 1/30 second.

In order to solve this problem, a television receiver which employs a cathode ray tube of the 2-beam system may be considered. A first electron beam Bm1 and a second electron beam Bm2 scan simultaneously the scanning lines on the picture screen with a distance of half the spacing between adjacent scanning lines in the vertical direction. FIGS. 1B and 1C illustrate scanning states of first and second electron beams Bm1 and Bm2 on a picture screen 100 for odd and even fields, respectively. Fig. 1A shows the scanning state for an electron beam Bm in the case of 1-beam system.

When there are 525 scanning lines, in the case of a 1-beam system, only 262.5 scanning lines are scanned within one field, while in the case of a 2-beam system, the remaining 262.5 scanning lines which will be scanned during the next field are scanned by, for example, the second electron beam Bm2 and then scanned so that 525 scanning lines can all be scanned within one field. Thus, the display period for each scanning line becomes 1/60 second, thereby removing line flicker.

For the above mentioned cathode ray tube of the 2-beam system, there has been proposed a cathode ray tube with the first and second cathodes for the first and second electron beams Bm1 and Bm2 disposed parallel to each other in the vertical direction. This previously proposed cathode ray tube, however, has the following defects.

For a deflection yoke for the cathode ray tube of the 2-beam system, in view of the convergence at respective portions of the picture screen, a deflection yoke of the CFD (convergence free deflection yoke) type may be desired. In this type of deflection yoke, the horizontal deflection coil is formed of a saddle winding, while the vertical deflection coil is formed of a toroidal winding, and thus the vertical deflection magnetic field will be extended primarily to the side of the tube neck. As a result, the deflection in the vertical direction is large. When the first and second cathodes are disposed parallel to each other in the vertical direction, in a cathode ray tube of the Trinitron (registered trademark) type, deflection plates 1 are disposed one on the other in the vertical direction y as shown in FIG. 2. Accordingly, in the case of the Trinitron type tube in the deflection yoke of the CFD type, there is a problem in that the electron beams Bm1 and Bm2 may strike the deflection plates 1. Therefore, the deflection plates 1 must be disposed at a position which is free from the influence of the vertical deflection magnetic field, thus increasing the length of the envelope of the cathode ray tube.

Moreover, in the deflection yoke of CFD type, usually, the horizontal deflection magnetic field is formed as a pin-cushion type as shown in FIG. 3A. Therefore, a horizontal deflection coil $C_H$ has a winding distribution such as shown in FIG. 4A, and the winding density thereof becomes lower at a position nearer to the axis y (in the vertical direction). To obtain such winding distribution, the horizontal deflection coil $C_H$ is manufactured by using a metal mold 2 as shown in FIG. 5A. In this case, the amount of wire material 3 which is wound deep in the metal mold 2 is small and the winding thereof is relatively easy and hence the accuracy during manufacturing is easy to obtain.

On the other hand, when the first and second cathodes are disposed parallel to each other in the vertical direction, the horizontal deflection magnetic field must be formed as a barrel type as shown in FIG. 3B. Therefore, for this type, the horizontal deflection coil $C_H$ must have a winding distribution such as shown in FIG. 4B, and the winding density thereof becomes higher at positions nearer to the axis y. To obtain the winding distribution shown in FIG. 4B, the horizontal deflection coil $C_H$ is manufactured by using a metal mold 2' as shown in FIG. 5B. Accordingly, in this case, the amount of the wire material 3 which is wound deep in the metal mold 2' is large, and it is difficult to wind and accuracy during manufacturing is difficult to obtain. In FIGS. 3 and 4, x represents the horizontal direction.

Furthermore, in the deflection yoke of CFD type, when the first and second cathodes are disposed parallel to each other in the vertical direction, the horizontal deflection magnetic field must be formed as the barrel type magnetic field as described above. However, this causes the beam spot shape $F_{BM}$ on a phosphor screen 4' to become long in the longitudinal direction at its periphery as shown in FIG. 6. Thus, the scanning lines overlapped each other, causing deterioration in the vertical resolution.

SUMMARY OF THE INVENTION

Accordingly, it is an object of the present invention to provide an improved cathode ray tube.

It is another object of the present invention to provide a cathode ray tube in which first and second cathodes are disposed in parallel to each other in the horizontal direction.

It is still another object of the present invention to provide a cathode ray tube which does not require tube length to be increased.

It is a further object of the present invention to provide a cathode ray tube which makes it easy to obtain accuracy during manufacturing of the deflection yoke.

It is a still further object of the present invention to provide a cathode ray tube which can prevent the vertical resolution from being deteriorated.

According to one aspect of the present invention, there is provided a cathode ray tube which comprises: first and second cathodes disposed parallel to each other in the horizontal direction; and deflecting means disposed along the paths of the first and second electron beams emitted from said first and second cathodes to apply to said first and second electron beams a rotational force relative to the center of the tube axis, whereby said first and second electron beams impinged on the phosphor screen such that they are spaced apart from each other by a distance of approximately half the distance between adjacent scanning lines in the vertical direction.

The other objects, features and advantages of the present invention will become apparent from the following description taken in conjunction with the accompanying drawings through which the like references designate the same elements and parts.

DESCRIPTION OF THE PREFERRED EMBODIMENTS

Figure 1A:
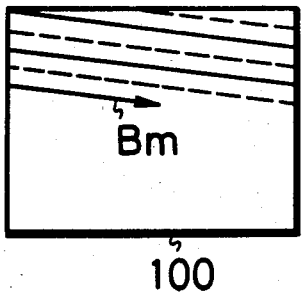
FIGS. 1A to 1C are respectively diagrams useful for explaining the scanning in a 2-beam system cathode ray tube.
Figure 1B:
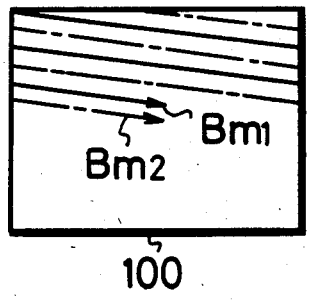
Figure 1C:
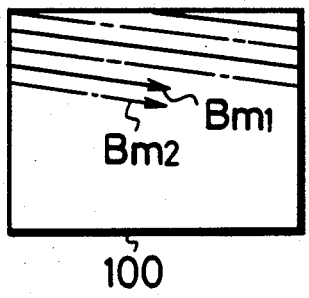
Figure 2:
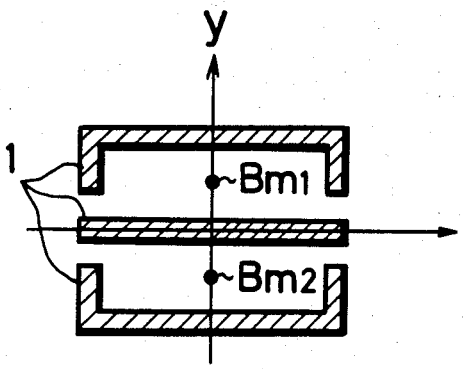
FIGS. 2 to 6 are respectively diagrams useful for explaining defects inherent in a cathode ray tube of the 2-beam system in which two cathodes are disposed in the vertical direction.
Figure 6:
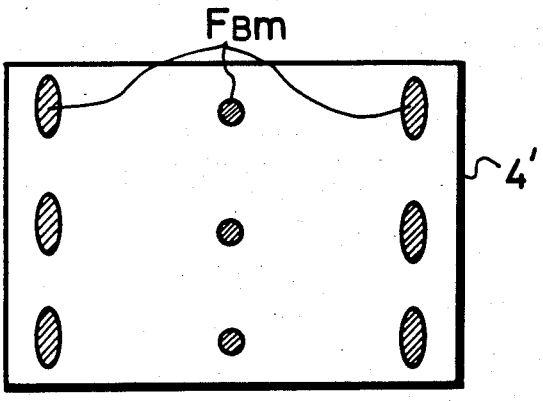
Figure 3A:
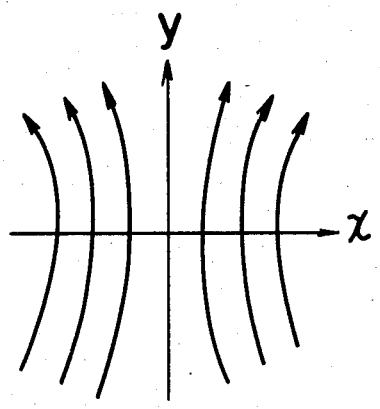
Figure 3B:
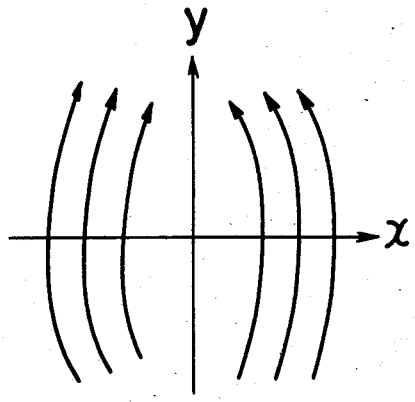
Figure 4A:
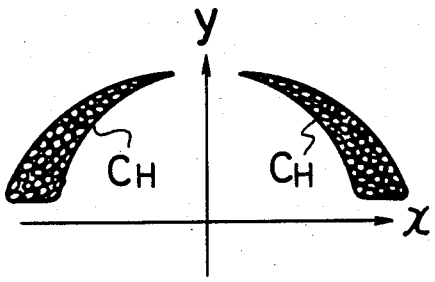
Figure 4B:
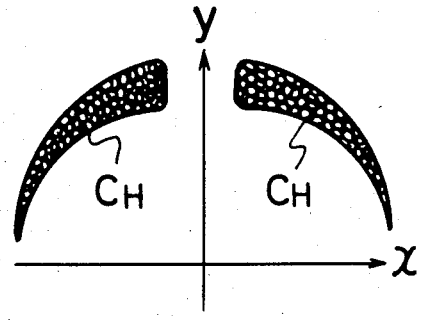
Figure 5A:
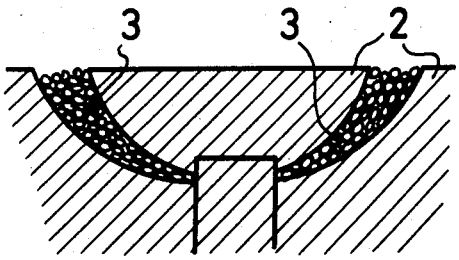
Figure 5B:
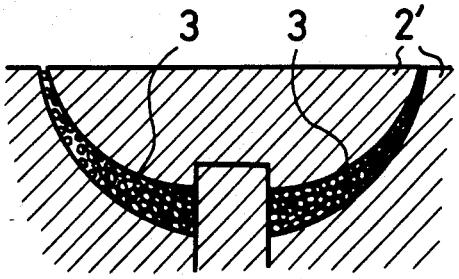
Figure 7:
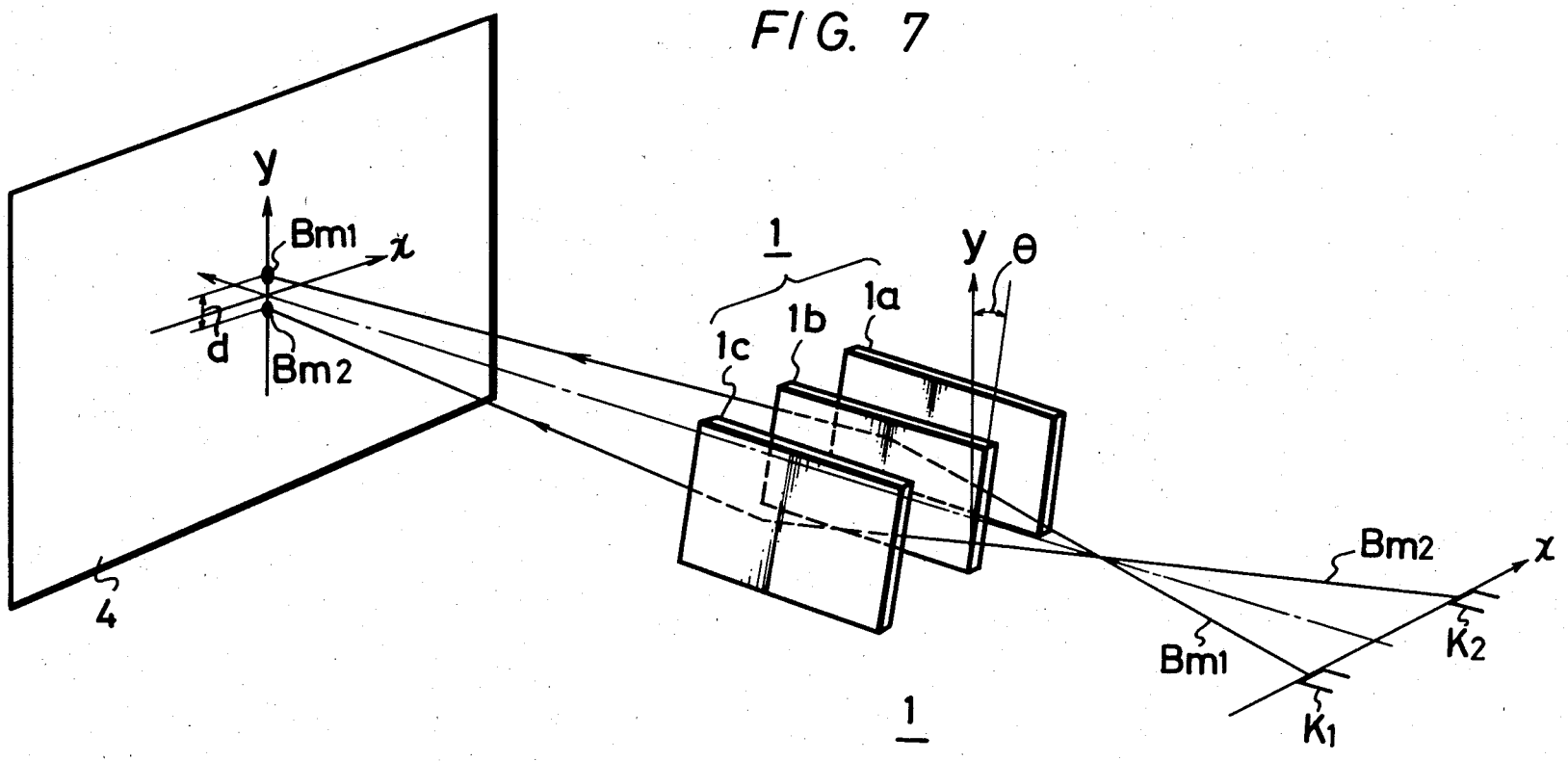
FIG. 7 is a schematic perspective view showing a main part of an embodiment of the cathode ray tube according to the present invention.

FIG. 7 is a diagram schematically showing an embodiment of the cathode ray tube according to the present invention which is applied to a Trinitron type tube. In FIG. 7, reference characters $K_1$ and $K_2$ respectively designate first and second cathodes for the first and second electron beams Bm1 and Bm2 and they are mounted parallel to each other and lie in the horizontal direction x. The first and second electron beams Bm1 and Bm2 from the first and second cathodes $K_1$ and $K_2$ pass through respective grids (not shown for simplicity of the drawing) and through an electrostatic deflection plate 1 to a phosphor screen 4. The electrostatic deflection plate 1 is formed of three deflection plates 1*a*, 1*b* and 1*c* which are mounted parallel to one another. The first electron beam Bm1 passes through the space between the deflection plates 1*a* and 1*b*, while the second electron beam Bm2 passes through the space between the deflection plates 1*b* and 1*c*.

The electrostatic deflection plate 1 is rotated by a predetermined angle 8, for example, which satisfies the condition $0° < \theta < 5°$ from the vertical direction y. Then, the first and second beams Bm1 and Bm2 impinge on the same position relative to the horizontal direction x but are spaced apart from each other by a distance d of approximately half the spacing or distance between the adjacent scanning lines relative to the vertical direction y. The reason why the first and second beams Bm1 and Bm2 are controlled as set forth as above by rotating the electrostatic deflection plate 1 will be described as follows.

Figure 8:
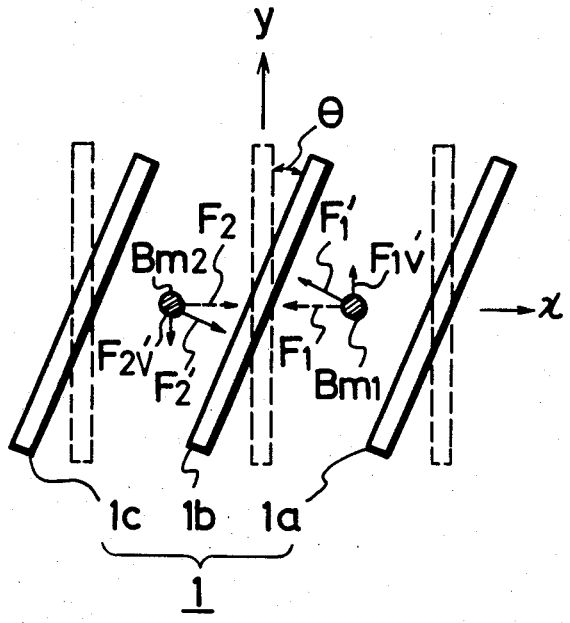
FIG. 8 is a diagram useful for explaining the embodiment of the present invention shown in FIG. 7.

The electrostatic deflection plate 1 causes the first and second electron beams Bm1 and Bm2 to be given forces which are substantially perpendicular to the electrostatic deflection plate 1. As shown by a broken line in FIG. 8, when the electrostatic deflection plate 1 is not rotated, the first and second electron beams Bm1 and Bm2 are subjected to only forces F1 and F2 which are opposite to each other relative to the horizontal direction x, respectively. On the other hand, as shown by a solid line in FIG. 8, when the electrostatic deflection plate 1 is rotated, the first and second electron beams Bm1 and Bm2 are subjected to forces F1' and F2' which are opposite to each other. These forces F1' and F2' have vertical direction components F1V' and F2V' in addition to the horizontal direction components. When the electrostatic deflection plate 1 is rotated as shown in FIG. 7, the first and second electron beams Bm1 and Bm2 are subject to rotational forces around the tube axis. In this case, depending on the magnitude of the rotational angle $\theta$ of the electrostatic deflection plate 1, the magnitudes of the vertical direction components F1V' and F2V' will vary and hence the magnitudes of the rotational forces which control the first and second electron beams Bm1 and Bm2 will be varied. When the electrostatic deflection plate 1 is rotated by the predetermined angle $\theta$, the first and second electron beams Bm1 and Bm2 can impinge on the phosphor screen 4 at the same position relative to the horizontal direction x, while they can impinge on the phosphor screen at positions spaced apart from each other by the distance d of approximately half the distance between the adjacent scanning lines relative to the vertical direction y.

Though not shown, the other constructional details of the tube are substantially the same as those of cathode ray tubes of the ordinary Trinitron type.

According to the embodiment shown in FIG. 7, the first and second cathodes K1 and K2 for the first and second electron beams Bm1 and Bm2 are disposed parallel to each other in the horizontal direction x and due to the fact that the electrostatic deflection plate 1 is rotated by the predetermined angle $\theta$, and the first and second electron beams Bm1 and Bm2 impinge on the phosphor screen 4 at the same vertical position relative to the horizontal direction x and at positions which are spaced apart vertically from each other by the distance d of approximately half the distance between the adjacent scanning lines. Accordingly, in the example of FIG. 7, since the first and second cathodes K1 and K2 are not mounted parallel to each other in the vertical direction y, the cathode ray tube according to the embodiment shown in FIG. 7 can remove the defects of the prior art in which (1) the length of a tube envelope is increased, (2) it is difficult to obtain accuracy during manufacturing of the deflection yoke and (3) wherein the shape of the peripheral beam spot becomes elongated in the longitudinal or vertical direction so that the vertical resolution is deteriorated.

Figure 9:
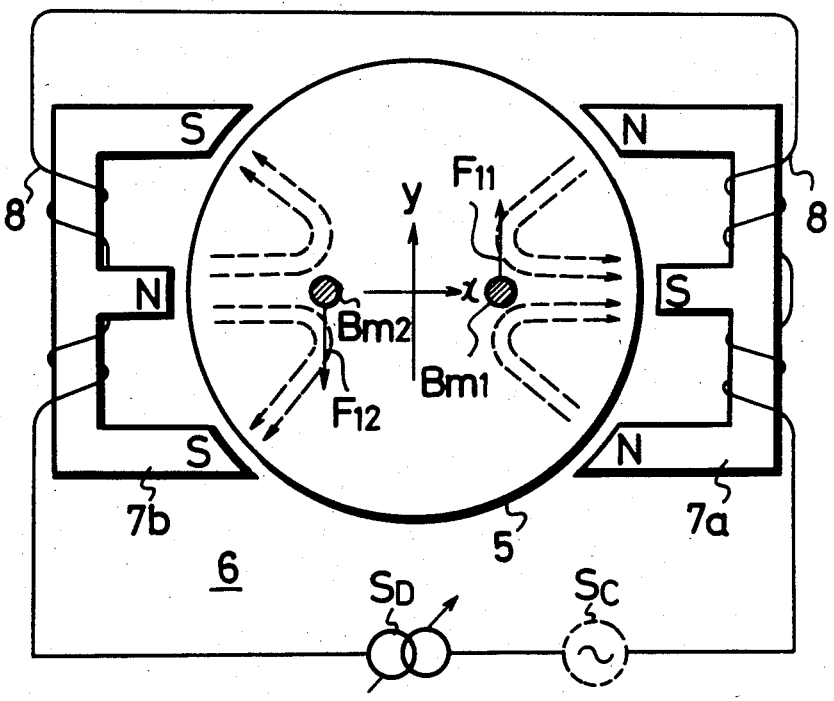
FIGS. 9 and 11 are respectively cross-sectional views of main parts illustrating other embodiments of the cathode ray tube according to the present invention.
Figure 11:
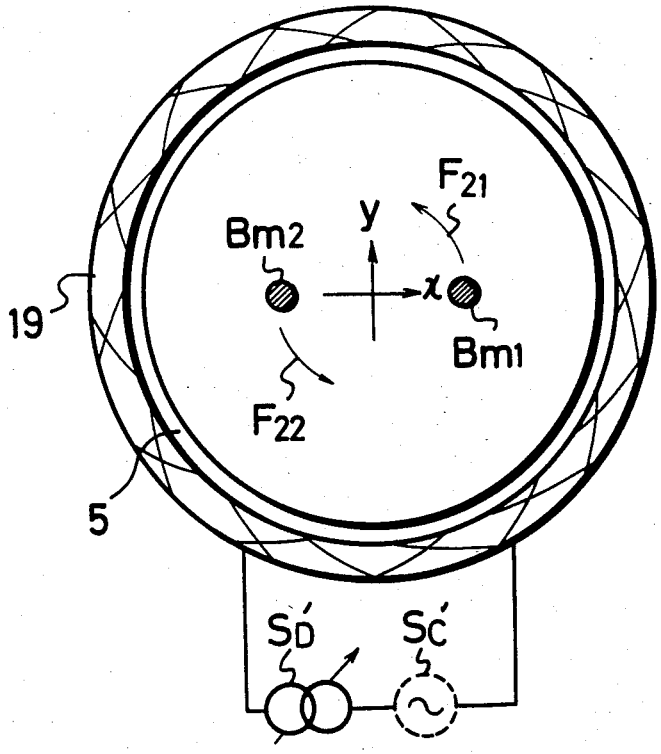

FIGS. 9 and 11 show other embodiments of the present invention, respectively.

In the embodiment shown in FIG. 9, the cathode ray tube is formed of, for example, the Trinitron type in which the first and second cathodes (not shown) for the first and second electron beams Bm1 and Bm2 are mounted parallel to each other in the horizontal direction x. In the embodiment shown in FIG. 9, a quadrupole magnet 6 is mounted in a position corresponding to, for example, the electrostatic deflection plate (not shown) of a neck portion 5. As a result, the first and second electron beams Bm1 and Bm2 impinge on the phosphor screen at the same position relative to the horizontal direction x and at positions spaced apart from each other by the distance d of approximately half the distance between the adjacent scanning lines relative to the vertical direction y.

The quadrupole magnet 6 is formed such that winding material 8 is wound around the cores *7a* and *7b*, each being formed of, for example, "E" shape, in a predetermined direction. A D.C. current $S_D$ of a predetermined magnitude flows in the winding material 8 so that the magnetic poles as shown in the Figure are produced at the tip ends of legs of the cores *7a* and *7b*, respectively.

In the embodiment shown in FIG. 9, the quadrupole magent 6 produces the magnetic fields shown by broken lines. In this case, if the first and second electron beams Bm1 and Bm2 move in the direction perpendicular to the sheet of the drawing, the first and second electron beams Bm1 and Bm2 are subjected to forces F11 and F12 which are opposite to each other in the vertical direction y. The first and second electron beams Bm1 and Bm2 are subjected to forces in the horizontal direction x so that they come toward the center due to the electrostatic deflection plate so that the first and second electron beams Bm1 and Bm2 are subject to rotational force with the tube axis as its center. In this case, depending on the magnitude of the magnetic field generated from the quadrupole magnet 6, the forces F11 and F12 vary and hence the magnitude of the rotational force applied to the first and second electron beams Bm1 and Bm2 will also vary. Accordingly, when the magnetic field generated by the quadrupole magnet 6 is controlled, by controlling the magnitude of the D.C. current $S_D$, in the same manner as the embodiment shown in FIG. 7, the first and second electron beams Bm1 and Bm2 can impinge on the phosphor screen 4 at the same position relative to the horizontal direction x and at vertical positions spaced apart from each other by the distance d of approximately half the distance between the adjoining scanning lines relative to the vertical direction y.

The reason why the quadrupole magnet 6 is mounted on the neck 5 in a position corresponding to the electrostatic deflection plate is that in this position the first and second electron beams Bm1 and Bm2 are spaced considerably apart from the tube axis and hence the control sensitivity is quite high.

In the embodiment in FIG. 9, when a correcting signal $S_C$ shown by a broken line flows together with the D.C. current $S_D$ through the winding material 8, the first and second electron beams Bm1 and Bm2 will impinge on the entire phosphor screen at the same position relative to the horizontal direction x and at vertical positions spaced apart from each other by the distance d of approximately half the distance between the adjoining scanning lines.

Figure 10:
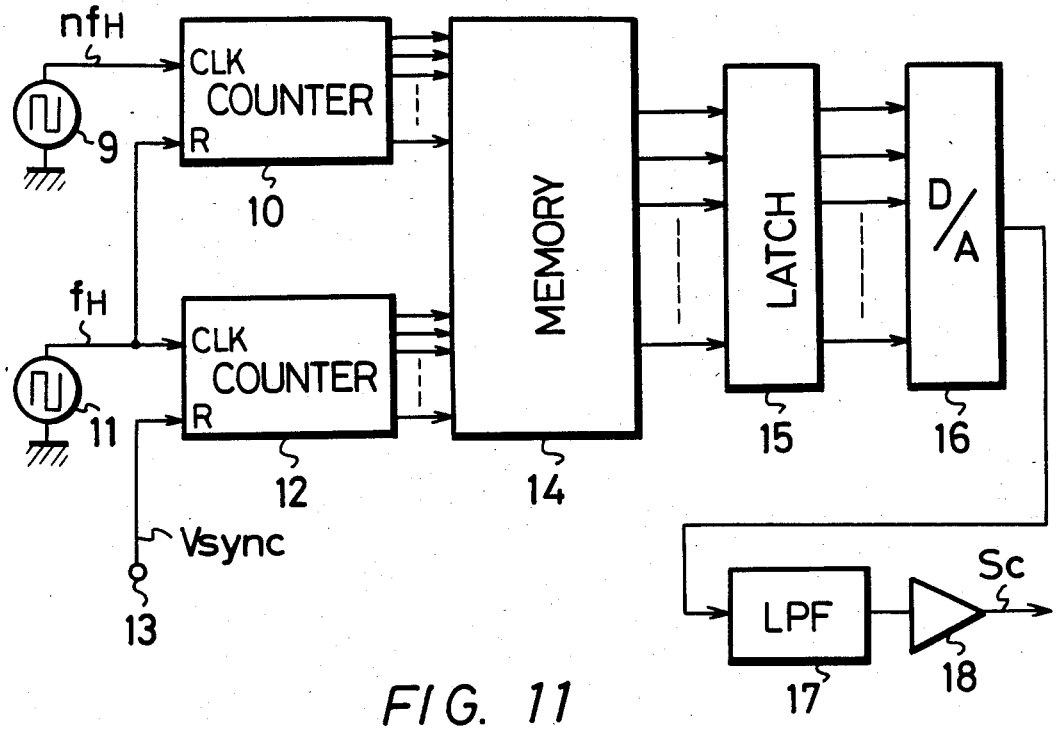
FIG. 10 is a circuit diagram showing an example of a circuit which supplies a correcting signal.

The correcting signal $S_C$ is a signal such as, for example, that shown in FIG. 10 in which the correcting signals at respective portions of the phosphor screen are written into a memory device in advance, and are then sequentially read out therefrom in response to the scanning positions of the first and second electron beams Bm1 and Bm2 and these signals can then be delivered for control.

In FIG. 10, reference numberal 9 designates a signal generator which generates a signal with a frequency $nf_H$ (n is an integer from 5 to 50 and $f_H$ represents the horizontal frequency). The signal with a frequency $nf_H$ derived therefrom is applied to a counter 10 which produces a read-out address signal. Reference numeral 11 designates a signal generator which generates a signal with a frequency $f_H$. The signal of frequency $f_H$ derived therefrom is supplied to a counter 12 which which produces a read-out address signal and is also supplied to the counter 10 as its reset signal. Also, to a terminal 13 is supplied a vertical synchronizing signal V sync to the counter 12 as its reset signal. From the counters 10 and 12 are derived the read-out address signals respectively corresponding to the scanning positions of the first and second electron beams Bm1 and Bm2. These read-out address signals are then supplied to a memory device 14. In the memory device 14 are written in advance the correcting signals which correspond to the scanning positions of the first and second electron beams Bm1 and Bm2. These correcting signals are sequentially read out therefrom in response to the address signals. The signals read out from the memory device 14 are latched by a latch circuit 15, then converted to analog signals by a D/A (digital-to-analog) converter 16 and then delivered through a low pass filter 17 and an amplifier 18 as the correcting signals $S_C$.

In the embodiment of FIG. 11, the cathode ray tube of the present invention is formed as, for example, by a Trinitron type tube in which the first and second cathodes (not shown) for the first and second electron beams Bm1 and Bm2 are mounted parallel to each other in the horizontal direction x. Then, in the embodiment in FIG. 11, at the position of the neck portion 5 corresponding to, for example, the electrostatic deflection plate (not shown) there is wound winding material 19 in the form of, for example, a solenoid winding. To the winding material 19 is supplied a D.C. current $S_D'$ of a predetermined magnitude to generate a magnetic field in the tube axis direction. In the embodiment of FIG. 11, the first and second electron beams Bm1 and Bm2 will impinge on the phosphor screen at the same position relative to the horizontal direction x and at vertical positions spaced apart from each other by the distance d of approximately half the distance between the adjacent scanning lines relative to the vertical direction y.

When the magnetic field in the tube axis direction is produced, the first and second electron beams Bm1 and Bm2 are subjected to rotational forces F21 and F22 which cause rotation with the tube axis as the center thereof. In this case, depending on the magnitude of the magnetic field, the magnitude of the rotational forces can be varied. Consequently, when the magnitude of the magnetic field thus generated from the winding material 19 is controlled, by controlling the magnitude of the D.C. current $S_D'$ as in the embodiment shown in FIG. 7, the first and second electron beams Bm1 and Bm2 will impinge on the phosphor screen 4 at the same position relative to the horizontal direction x and at the vertical positions spaced apart from each other by the distance d of approximately half the distance between the adjacent scanning lines relative to the vertical direction y.

The reason why the winding material 19 is mounted at the position corresponding to that of the electrostatic deflection plate at the neck portion is the same as that given for the above embodiment shown in FIG. 9.

Also in the embodiment shown in FIG. 11, when the correcting signal $S_C'$ flows together with the D.C. current $S_D'$ to the winding material 19, the first and second electron beams Bm1 and Bm2 will impinge on the entire area of the phosphor screen at the same positions relative to the horizontal direction x and at vertical positions spaced apart from each other by the distance d of approximately half the distance between the adjacent scanning lines relative to the vertical direction y.

As described above, in the embodiments shown in FIGS. 9 and 11, since the first and second cathodes for the first and second electron beams Bm1 and Bm2 are mounted parallel to each other in the horizontal direction, a similar action and effect as those of the embodiment of FIG. 7 can be achieved.

In the above embodiments, the examples of the cathode ray tube formed as a Trinitron type are illustrated. Also in other inline systems in which the cathodes are mounted parallel to each other, the same constructions as those in the embodiments shown in FIGS. 9 and 11 can be made. In that case, it is desired that the quadrupole magnet 6 and the winding material 19 be mounted in the neck position in which the first and second electron beams Bm1 and Bm2 are apart a relative distance from the tube axis.

Moreover, while in the embodiment shown in FIG. 7 the correcting means thereof was not described, it is possible to employ that used in the embodiment in FIG. 9 or the embodiment in FIG. 11 as the correcting means.

Furthermore, in the inline systems other than of the Trinitron type, the deflection plates may be mounted inside to control the first and second electron beams Bm1 and Bm2 in the same way as in the embodiment shown in FIG. 7.

According to the present invention as described above, since the first and second cathodes for the first and second electron beams are mounted parallel to each other in the horizontal direction, the cathode ray tube of the present invention can remove the defects caused by the fact that the first and second cathodes are mounted in the vertical direction, namely, (1) the tube length is increased (2) it is difficult to obtain accuracy in manufacturing the deflection yoke and (3) the shape of the peripheral beam spot becomes longer in its vertical direction which causes the vertical resolution is deteriorated.

The above description is given for the preferred embodiments of the invention, but it will be apparent that many modifications and variations could be effected by one skilled in the art without departing from the spirits or scope of the novel concepts of the invention, so that the scope of the invention should be determined by the appended claims only.

We claim:

1. A cathode ray tube with a phosphor screen comprising: first and second cathodes mounted on a horizontal line parallel to each other, and deflecting means through which first and second electron beams emitted from said first and second cathodes pass mounted so as to apply to said first and second electron beams a rotational force about the center of the tube axis, whereby said first and second electron beams impinge on said phosphor screen at positions which are vertically spaced apart from each other by a distance of approximately half the distance between adjacent scan lines.

2. A cathode ray tube according to claim 1, in which said deflecting means comprises electrostatic deflection plates.

3. A cathode ray tube according to claim 1, in which said deflecting means comprises a quadrupole magnet.

4. A cathode ray tube according to claim 1, in which said deflecting means comprises a solenoid coil.

5. A cathode ray tube with a phosphor screen in which the image is improved comprising: a pair of electron guns with a pair of cathodes for generating a pair of electron beams and said pair of cathodes mounted parallel to each other on a horizontal line and spaced apart a fixed distance, and electron beam deflecting means through which said pair of electron beams pass mounted so as to apply to said electron beams a rotational force about the center of the tube axis, whereby said electron beams form scanning spots on said phosphor screen which fall on a vertical line and wherein the scanning spots are separated vertically by a distance approximately equal to one half the distance between adjacent scan lines.

6. A cathode ray tube according to claim 5 wherein said electron beam deflection means comprises planar electrostatic deflection plates which are parallel to each other and which lie in planes displaced from the vertical by an angle greater than zero but not more than 5°.

7. A cathode ray tube according to claim 5 wherein said deflecting means comprises an electromagnet.

8. A cathode ray tube according to claim 7 including means for generating a control current for said electromagnet so that the proper vertical spacing of said scanning spots occur over the entire phosphor screen and including a memory means in which said control current for locations of the phosphor screen are stored and supplied to said deflecting means to produce spots on said screen which fall on the same vertical line and are spaced a fixed vertical distance apart.

* * * * *